United States Patent [19]

Stewart

[11] Patent Number: 4,919,782

[45] Date of Patent: Apr. 24, 1990

[54] ALUMINA REDUCTION CELL

[75] Inventor: Douglas V. Stewart, Florence, Ala.

[73] Assignee: Reynolds Metals Company, Richmond, Va.

[21] Appl. No.: 312,833

[22] Filed: Feb. 21, 1989

[51] Int. Cl.[5] ..... C25C 3/08

[52] U.S. Cl. ..... 204/243 R; 204/245; 204/288; 204/291; 204/294

[58] Field of Search ..... 204/243–247, 204/286–289, 294, 291

[56] References Cited

U.S. PATENT DOCUMENTS

| | | | |
|---|---|---|---|
| 3,287,247 | 11/1966 | Dewey | 204/243 |
| 4,177,128 | 12/1979 | Rahn | 204/243 R |
| 4,308,115 | 12/1981 | Foster, Jr. et al. | 204/67 |
| 4,339,316 | 7/1982 | Peterson et al. | 204/243 R |
| 4,349,427 | 9/1982 | Goodnow et al. | 204/243 R |
| 4,376,690 | 3/1983 | Kugler | 204/289 X |
| 4,396,482 | 8/1983 | Das et al. | 204/245 X |
| 4,436,598 | 3/1984 | Tabereaux et al. | 204/67 |
| 4,460,440 | 7/1984 | McGeer | 204/67 |
| 4,504,366 | 3/1985 | Jarrett et al. | 204/1 R |
| 4,532,017 | 7/1985 | Keinborg et al. | 204/67 |
| 4,533,452 | 8/1985 | Leray et al. | 204/243 R |
| 4,631,121 | 12/1986 | Stewart et al. | 204/243 R |

*Primary Examiner*—Donald R. Valentine

*Attorney, Agent, or Firm*—Alan T. McDonald

[57] ABSTRACT

An improved alumina reduction cell is described in which the carbonaceous cathode includes refractory hard metal shapes forming the true cathode surface and inert refractory protective sleeves for the refractory hard metal shapes. Reduced amounts of refractory hard metal material are employed through an improved refractory hard metal support system.

16 Claims, 3 Drawing Sheets

ALUMINA REDUCTION CELL

BACKGROUND OF THE INVENTION

Aluminum metal is conventionally produced by the electrolytic reduction of alumina dissolved in a molten cryolite bath according to the Hall-Heroult process.

This process for reducing alumina is carried out in a thermally insulated cell or "pot" which contains the alumina-cryolite bath. The cell floor, typically made of a carbonaceous material, overlies some of the thermal insulation for the cell and serves as a part of the cathode. The cell floor may be made up of a number of carbonaceous blocks bonded together with a carbonaceous cement, or it may be formed using a rammed mixture of finely ground carbonaceous material and pitch. The anode, which usually comprises one or more carbonaceous blocks, is suspended above the cell floor. Resting on the cell floor is a layer or "pad" of molten aluminum which the bath sees as the true cathode. The anode, which projects down into the bath, is normally spaced from the pad at a distance of about 1.5 to 3.0 inches (3.81 to 7.61 cm). The alumina-cryolite bath is maintained on top of the pad at a depth of about 6.0 to 12.0 inches (15.24 to 30.48 cm).

As the bath is traversed by electric current, alumina is reduced to aluminum at the cathode and carbon is oxidized to its dioxide at the anode. The aluminum thus produced is deposited on the pad and tapped off periodically after it has accumulated.

For the electrolytic process to proceed efficiently, the alumina reduction should occur onto a cathode surface of aluminum and not the bare carbonaceous surface of the cell floor. Therefore, it is considered important for the pad to cover the cell floor completely.

As molten aluminum does not readily wet or spread thinly on carbonaceous materials, the pad can best be visualized as a massive globule on the cell floor. In larger cells, the dense currents of electrolysis give rise to powerful magnetic fields, sometimes causing the pad to be violently stirred and to be piled up in selected areas within the cell. Therefore, the pad must be thick enough so that its movements do not expose the bare surface of the cell floor. Additionally, the anode must be sufficiently spaced from the pad to avoid short circuiting and to minimize reoxidation of aluminum.

Still, the movements of the pad have adverse effects which cannot always be readily controlled. For a given cell operating with a particular current of electrolysis, there is an ideal working distance between the cathode and the anode for which the process will be most energy efficient. However, the required spacing of the anode due to turbulence of the pad prevents this ideal working distance from being constantly maintained. Further, since the pad is in a state of movement, a variable, nonuniform working distance is presented. Thus, variable interelectrode distance is presented. This variable interelectrode distance can cause uneven wear or consumption of the anode. Pad turbulence can also cause an increase in back reaction or reoxidation at the anode of cathodic products, which lowers cell efficiency. In addition, pad turbulence leads to accelerated bottom liner distortion and degradation through thermal effects and through penetration by the cryolite and its constituents.

It has been suggested in the literature and prior patents that certain special materials, such as refractory hard metals (RHM), most notably titanium diboride ($TiB_2$) or its homologs, can be used advantageously in forming the cell floor. Further, it has been found that RHM shapes may be placed onto the cell floor, rising vertically through the molten aluminum layer and into the cryolite-alumina bath, with the uppermost ends of these shapes forming the true cathode. When such a cathode design is employed, precise spacing between the true or active surfaces of the cathode and the anode may be maintained, since such a system is not affected by the ever-moving molten aluminum pad.

Ideally, in contrast to conventional carbon products, these RHM materials are chemically compatible with the electrolytic bath at the high temperatures of cell operation and are also compatible chemically with molten aluminum.

Furthermore, these special cell floor materials are wetted by molten aluminum. Accordingly, the usual thick metal pad should no longer be required, and molten aluminum may be maintained on the cell floor as a relatively thin layer and commensurate with amounts accumulating between the normal tapping schedule.

Although RHM materials may benefit greatly the aluminum reduction process, their use has met with limited commercial acceptability. Primarily, their use has been limited by the cost of equipping an alumina reduction cell with an RHM cathode system. Refractory hard metal shapes are expensive and the amount of RHM material required to support an alumina reduction cell, especially in view of the fact that pot lines may contain over a hundred such cells, has been prohibitive, whether considered for new cell construction or in retrofitting rebuilt cells.

There remains, therefore, a need to provide the benefits of RHM materials in alumina reduction cells while reducing the costs of constructing such cells.

THE PRESENT INVENTION

By means of the present invention, the desired goal of reducing RHM usage in an alumina reduction cell has been achieved. The alumina reduction cell of the present invention employs a support mechanism for the refractory hard metal shapes which enables shapes having less volume than previously possible to be employed. The system comprises protective sleeves surrounding the RHM shape and either a carbonaceous platform within the sleeve upon which the RHM material may rest or the employment of a RHM shape which rests upon the upper surface of the sleeve and which projects downwardly into the sleeve to prevent the RHM shape from becoming dislodged during operation of the cell.

BRIEF DESCRIPTION OF THE DRAWINGS

The alumina reduction cell of the present invention will be more fully described with reference to the FIGURES in which.

DETAILED DESCRIPTION OF THE PREFERRED EMBODIMENTS

Figure 1:
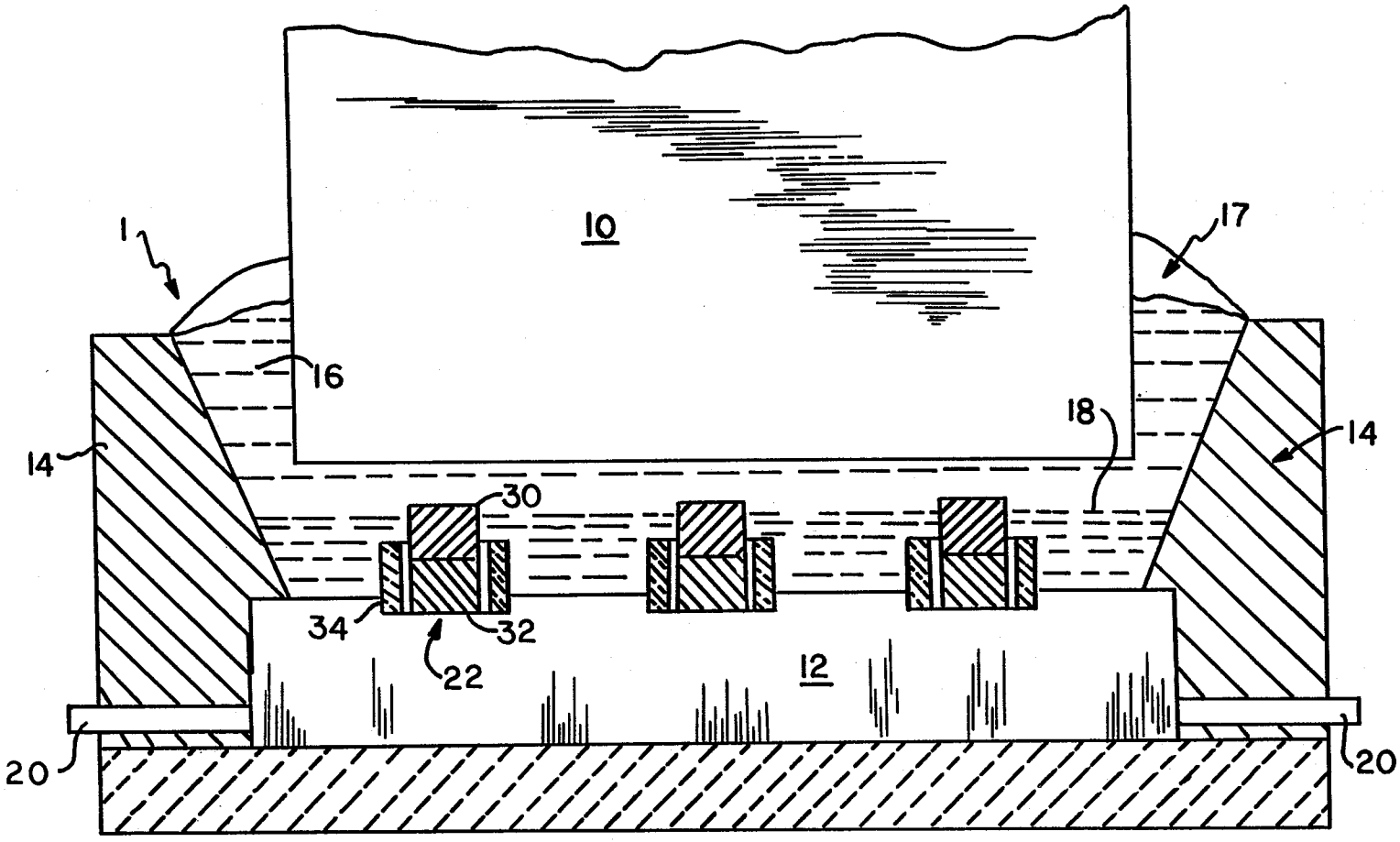
FIG. 1 is a cross-sectional view of an alumina reduction cell employing the improved RHM mounting system of the present invention.

FIG. 1 illustrates an alumina reduction cell 1 employing the present invention. Anode blocks 10, formed from a carbonaceous material, are suspended within a bath 16 of alumina dissolved in molten cryolite and are attached to a source of electrical current by means not shown. A crust 17 of frozen cryolite-alumina covers the bath 16. Carbonaceous cathode blocks 12 may be joined together by a rammed mixture of pitch and ground carbonaceous material or by means of a carbonaceous cement, by means well-known to those skilled in the art. These cathode blocks 12 are connected by means of conductor bus bars 10 to the electrical current source to complete the electrical circuit. Outer walls 14 form the side and end supporting structures for the cell 1. The walls 14 may be formed, for example, from graphite blocks held together with a graphitic cement.

The carbonaceous blocks 12 include a plurality of refractory hard metal (RHM) shape containing units 22. These units 22 are more fully described in FIGS. 2 and 3.

Figure 2:
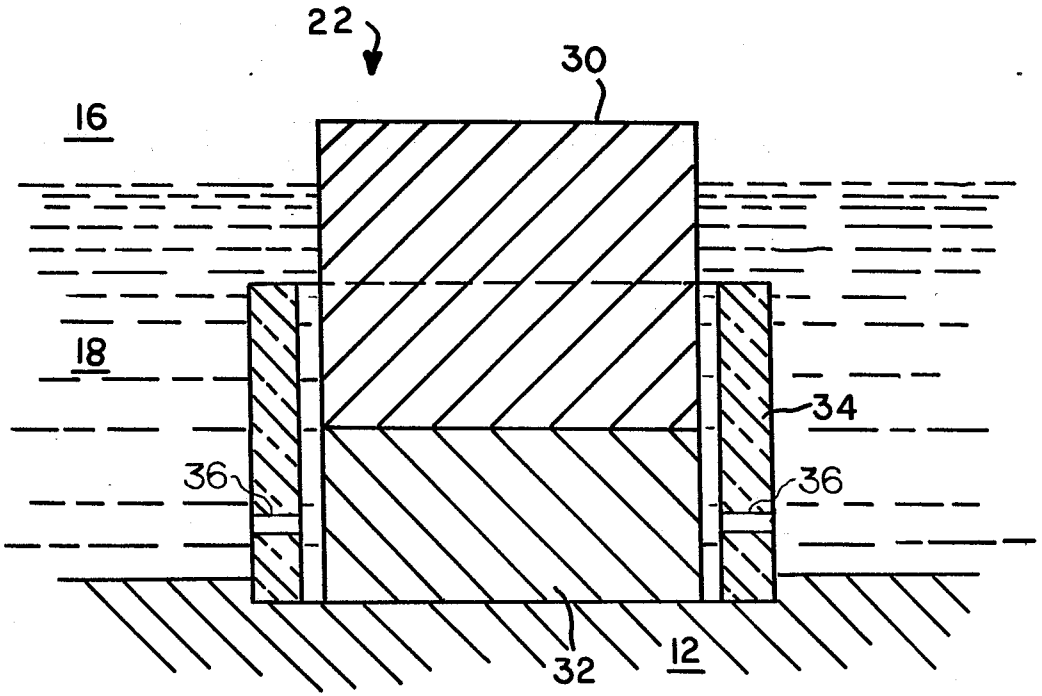
FIG. 2 is a cross-sectional view of one of the RHM shape-mounting system elements according to a first embodiment of the present invention.

Turning now to FIG. 2, a first RHM shape containing unit 22 is illustrated. The RHM units 22 include a central shape 30. The RHM shapes 30 may take any of numerous cross-sectional shapes, such as rectangular, square or the like, but preferably are in the form of a cylinder, due to the ease of forming such a shape. The shapes 30 are refractory hard metal (RHM) shapes, which may be formed of such materials as $TiB_2$, $TiB_2$-AlN mixtures, and other similar materials, typically by hot pressing or sintering RHM powders to form the shapes. These refractory hard metals are wetted by molten aluminum, where they pass through the molten aluminum layer 18, preventing globules of molten aluminum from forming at the interfaces with the shapes 30 and reducing movement of the molten aluminum pad 18. To minimize cracking during use of these shapes, the RHM shapes may be reinforced with carbon, graphitic or silicon carbide fibers or particles, which are added to the powders forming the shapes 30 prior to hot pressing or sintering. When fibers are employed, fibers may be random or uniform in length and are oriented in the plane perpendicular to the direction of hot pressing.

The RHM shape 30 rests upon a platform 32 of carbonaceous material. This carbonaceous material may be added to the carbonaceous cathode 12 or may be formed as a part of the carbonaceous cathode 12 during construction of the cell 1. The RHM shape 30 is not fixed to the carbonaceous platform 32, but rather rests on the surface of the platform 32. Thus, the RHM shapes are easily replaceable during the life of a cell by hot exchange. To stabilize the RHM shapes 30, a short ceramic/refractory positioning element or sleeve 34 surrounds the RHM shape. This element 34 is fixedly mounted to the carbonaceous cathode 12, such as by cementing with a carbonaceous cement or the like, and has a cross-sectional shape corresponding to that of the RHM shape 30. This orienting and stabilizing element 31 is shorter than the RHM shape 30 and has a height less than the metal pad 18 to prevent disillusion of the material forming the stabilizing or orienting shape 34 in the alumina-cryolite bath. This stabilizing element 34 may be formed of such materials as silicon nitride bonded silicon carbide, aluminum nitride, silicon nitride, silicon carbide, boron nitride and the like. The inner diameter of the stabilizing element 34 is slightly larger than the outer diameter of the RHM shape 30, such as about 0.0625 to about 0.375 inches (0.1588 to about 0.9525 cm), so that the RHM shape is easily removed and replaced, but yet closely enough corresponding to the RHM shape to stabilize it in the cell, thus preventing dislodging of the RHM element 30 during cell production. The carbonaceous mounting platform 32 and the stabilizing sleeve 34 may be positioned in a depression within the cathode 12.

Such sleeves are described in U.S. Pat. No. 4,631,121, the disclosure of which is incorporated herein by reference.

Figure 3:
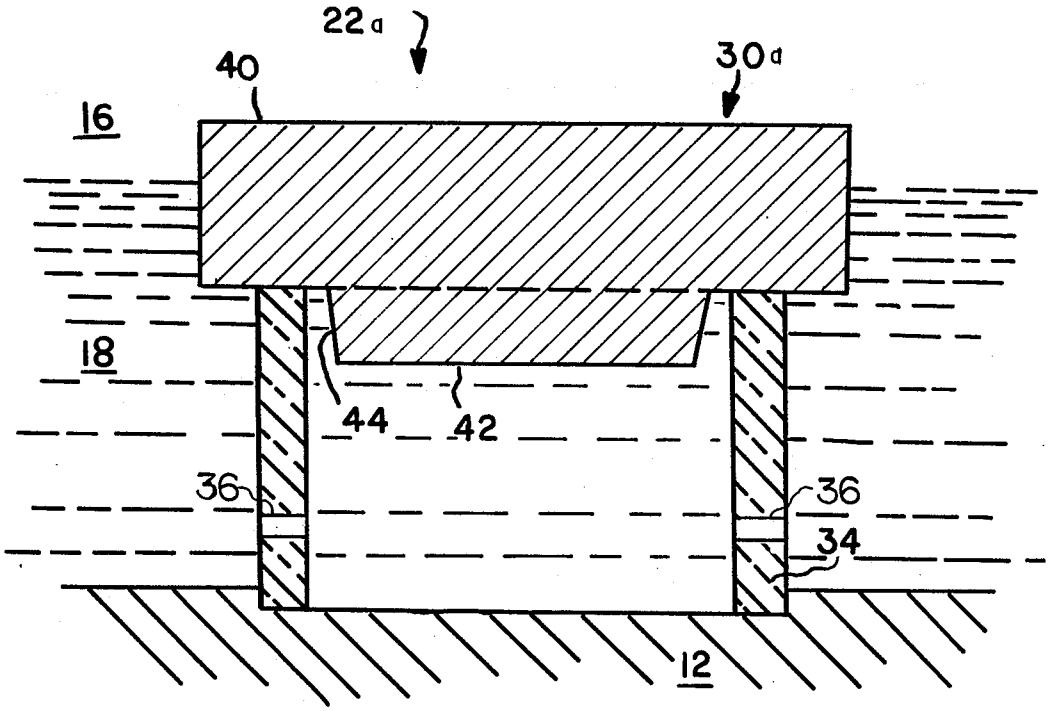
FIG. 3 is a cross-sectional view of one of the RHM shape-mounting system elements according to a second embodiment of the present invention.

Turning to FIG. 3, a second embodiment of a reduced usage RHM shape-stabilizing element unit is illustrated. In this embodiment, the stabilizing element 34 is identical to that in FIG. 2. However, in this embodiment the RHM shape 30*a* forming the unit 22*a* with stabilizing element 34 has been modified.

The RHM shape 30*a* has a main body 40 which is sized to extend horizontally beyond the upper surface of stabilizing element 34 and rest on the upper surface of stabilizing element 34. To prevent dislodging of RHM shape 30*a* during production of the cell, the RHM shape 30*a* includes a downward projection 42 positioned within stabilizing element 34. The projection 42 is of a height sufficient to prevent the RHM shape 30*a* from becoming dislodged from stabilizing element 34 due to tipping forces resulting from movement of the metal pad 18. At the same time, the projection 42 permits hot exchange of RHM shapes 30*a* by vertical removal from stabilizing element 34.

Preferably, the side surfaces 44 of projection 42 are inwardly tapered to reduce damage to the projection 42 during production of the cell and any resulting movement of RHM shapes 30*a*.

To permit molten aluminum metal to flow freely within the cell, elements 34 contain one or more slots or holes 36 therein near the base thereof.

From the foregoing, it is clear that the present invention provides a simple, yet effective means for reducing refractory hard metal usage requirements in an alumina reduction cell.

While presently preferred embodiments of the invention have been illustrated and described above, it is clear that the invention may be otherwise variously embodied and practiced within the scope of the following claims.

We claim:

1. In an alumina reduction cell having an anode, a carbonaceous cathode, a plurality of refractory hard metal (RHM) shapes, said RHM shapes having a height sufficient to extend vertically upwardly through a molten aluminum pad and into an alumina-cryolite bath, and a plurality of inert refractory stabilizing sleeves for said RHM shapes, said sleeves being fixedly mounted to said cathode, said sleeves extending vertically into said molten aluminum pad but not into said alumina-cryolite bath, the improvement comprising means for supporting said RHM shapes within said sleeves to thereby permit a reduction in the volume of RHM material in said RHM shapes, said means comprising platforms of carbonaceous material extending upwardly from said cathode and positioned within said sleeves, said platforms having a height less than said sleeves to permit said RHM shapes to rest upon said platforms and within said sleeves without becoming dislodged from said sleeves during movements of said molten aluminum pad.

2. The cell of claim 1 wherein said sleeves are formed from a material selected from the group consisting of silicon carbide, silicon nitride, aluminum nitride, boron nitride and silicon nitride bonded silicon carbide.

3. The cell of claim 1 wherein said sleeves are cemented into said cathode by means of a carbonaceous cement.

4. The cell of claim 1 wherein said sleeves are positioned into depressions formed in said cathode.

5. The cell of claim 1 wherein said RHM shapes are formed from a material selected from the group consisting of titanium diboride and titanium diboride - aluminum nitride mixtures.

6. The cell of claim 1 wherein said RHM shapes are fiber reinforced.

7. The cell of claim 1 wherein said sleeves are in the form of cylinders.

8. The cell of claim 1 wherein said sleeves include at least one opening therein to permit said molten aluminum to flow freely in said cell.

9. In an alumina reduction cell having an anode, a carbonaceous cathode, a plurality of refractory hard metal (RHM) shapes, said RHM shapes having a height sufficient to extend vertically upwardly through a molten aluminum pad and into an alumina-cryolite bath, and a plurality of inert refractory stabilizing sleeves for said RHM shapes, said sleeves being fixedly mounted to said cathode, said sleeves extending vertically into said molten aluminum pad but not into said alumina-cryolite bath, the improvement comprising means for supporting said RHM shapes within said sleeves to thereby permit a reduction in the volume of RHM material in said RHM shapes, said means comprising downward projections of said RHM shapes into said sleeves and a main body of said RHM shapes having a size to extend horizontally beyond said sleeves and resting on the upper surfaces of said sleeves.

10. The cell of claim 9 wherein said sleeves are formed from a material selected from the group consisting of silicon carbide, silicon nitride, aluminum nitride, boron nitride and silicon nitride bonded silicon carbide.

11. The cell of claim 9 wherein said sleeves are cemented into said cathode by means of a carbonaceous cement.

12. The cell of claim 9 wherein said sleeves are positioned into depressions formed in said cathode.

13. The cell of claim 9 wherein said RHM shapes are formed from a material selected from the group consisting of titanium diboride and titanium diboride - aluminum nitride mixtures.

14. The cell of claim 9 wherein said RHM shapes are fiber reinforced.

15. The cell of claim 9 wherein said sleeves are in the form of cylinders.

16. The cell of claim 9 wherein said sleeves include at least one opening therein to permit said molten aluminum to flow freely in said cell.

* * * * *